United States Patent [19]

Eskeli

[11] 4,068,975

[45] Jan. 17, 1978

[54] FLUID PRESSURIZER

[76] Inventor: Michael Eskeli, 7994-41 Locke Lee, Houston, Tex. 77042

[21] Appl. No.: 754,734

[22] Filed: Dec. 27, 1976

Related U.S. Application Data

[63] Continuation-in-part of Ser. No. 568,895, April 17, 1975, Pat. No. 4,003,673, and a continuation-in-part of Ser. No. 636,310, Nov. 18, 1975, Pat. No. 4,012,164.

[51] Int. Cl.[2] ..... F01D 1/18

[52] U.S. Cl. ..... 415/80

[58] Field of Search ..... 415/80; 60/482; 416/179

[56] References Cited

U.S. PATENT DOCUMENTS

| | | | |
|---|---|---|---|
| 2,768,808 | 10/1956 | Worre | 415/80 |
| 3,879,152 | 4/1975 | Eskeli | 415/80 |
| 4,003,673 | 1/1977 | Eskeli | 415/80 |
| 4,012,164 | 3/1977 | Eskeli | 415/80 |
| 4,030,856 | 6/1977 | Eskeli | 415/80 |

*Primary Examiner*—C. J. Husar

[57] ABSTRACT

A method and apparatus for the pressurizing of fluids within a rotating rotor wherein a fluid enters the rotor near center, is first pressurized by centrifugal force with initial acceleration and is then further accelerated and pressurized within a circular cavity in a free vortex. The fluid then leaves the circular cavity via openings at periphery and is passed inwardly toward rotor center via passages, and discharged via opening near rotor center. Fluids may be gases or liquids. The device can be used either as a pump, a compressor, or a turbine as desired.

2 Claims, 4 Drawing Figures

FLUID PRESSURIZER

CROSS REFERENCES TO RELATED APPLICATIONS

This is a continuation-in-part of patent application "Fluid Pressurizer", Ser. No. 568,895, filed Apr. 17, 1975 now U.S. Pat. No. 4,003,673, and "Rotor with Recirculation", Ser. No. 636,310, filed Nov. 28, 1975 now U.S. Pat. No. 4,012,164.

BACKGROUND OF THE INVENTION

This invention relates to fluid pressurizers where a centrifugal force is used to increase the pressure of the fluid.

In previous fluid pressurizers of the centrifugal type, fluid is accelerated in the rotor, and then decelerated in the casing producing pressure. These methods are costly in power consumption due turbulence and friction losses, and for high pressures, the operation may become unstable, which is ordinarily corrected by adding stages, thus further increasing the cost of the unit.

SUMMARY OF THE INVENTION

It is an object of this invention to a means for pressurizing fluids with a reduced power requirement while still maintaining a relatively simple construction for the pressurizer. It is also an object of this invention to provide a rotor for such pressurizer which can be operated in multistage arrangements, or be used in situations where high rotor speeds are desirable.

BRIEF DESCRIPTION OF THE DRAWINGS

Referring to FIG. 1, therein is shown an axial cross section of a pressurizer. 10 is base, 11 is bearing, 12 is fluid entry, 13 is shaft, 14 is pressurizing cavity provided with vanes, 15 is recirculation passage, 16 is free vortex cavity, 17 are fluid exit openings which may be nozzles, 18 are fluid inward passages, 19 are fluid entry nozzles into free vortex cavity, 20 is bearing, 21 is fluid exit opening, 9 is rotor.

In FIG. 2, an end view of the unit of FIG. 1 is shown. 10 is base, 21 is fluid exit, 23 indicates rotation, 9 is rotor, 17 are fluid exits from vortex cavity, 18 are inward passages.

In FIG. 3, a cross section of another form of the unit is shown, where entry and exit for the fluid are on the same side of the rotor. 30 is base, 31 is bearing, 32 is shaft, 33 is pressurizing cavity, 34 are nozzles, 35 is free vortex cavity, 36 are openings for fluid exit, 37 are inward passages, 38 is seal, 39 is fluid exit passage into exit 41, 40 is fluid entry which may be tapered as shown, 42 is support for the fluid connections assembly.

In FIG. 4, a rotor is shown; this rotor may be used within a vessel, in the open, or in multistage arrangements. 49 is rotor, 50 and 51 are support and bearing, 52 is shaft, 53 is fluid entry, 54 is pressurizing cavity, 55 are fluid nozzles into free vortex cavity 57, and 56 are exit openings or nozzles for the fluid.

In operation, fluid enters via opening 12, is pressurized by centrifugal force in cavity 14 where vanes are used to assure that the fluid rotates with the rotating rotor, after which the fluid passes via nozzles 19 forwardly into free vortex cavity 16, and there is pressurized by centrifugal force while traveling within the curved path formed by cavity 16. After pressurization, the fluid leaves via openings or nozzles 17 and is passed inwardly via passages 18 to exit 21. The passages 18 may be radial, or they may be arranged to be either forwardly or backwardly as desired; in FIG. 2, the passages 18 are forwardly to allow the fluid to lead the rotor, and thus retain additional pressure while passing toward rotor center. Work is recovered from the fluid in passages 18, the amount of work recovered will depend of the design of the slope of the passages 18. The passage 15 is used to recirculate the fluid taking fluid from the free vortex cavity at periphery, and discharging via nozzles near center; purpose of this recirculation is to increase the fluid tangential velocity within the rotor free vortex cavity.

Figure 1:
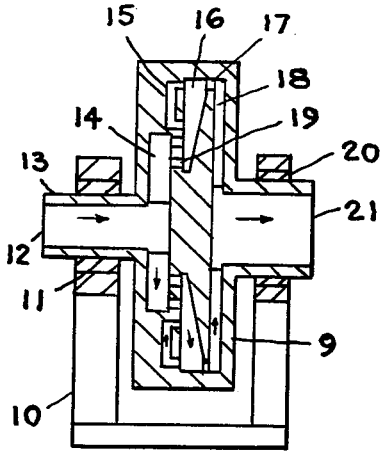
FIG. 1 is an axial cross section of the pressurizer.
Figure 2:
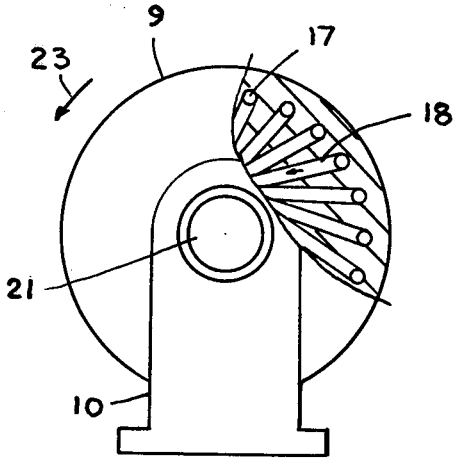
FIG. 2 is an end view of the unit of FIG. 1.
Figure 3:
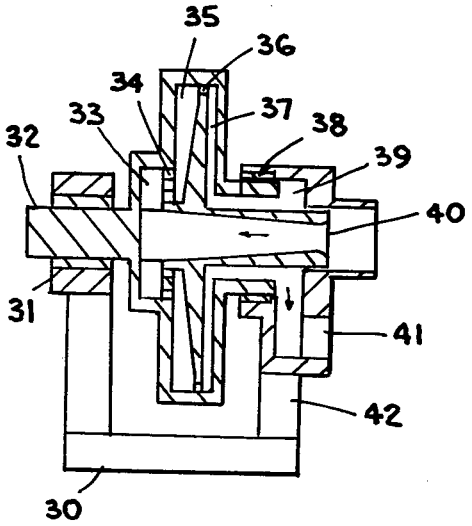
FIG. 3 is a cross section of a different arrangement of a unit similar to the unit shown in FIG. 1.
Figure 4:
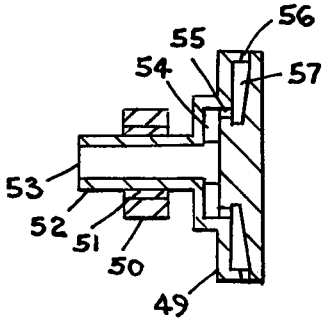
FIG. 4 is a cross section of a rotor for the pressurizer with fluid discharge at the rotor periphery.

The openings 56 may be nozzles arranged to discharge the fluid backwardly, if desired. For the rotor of FIG. 4, various arrangements for supporting shaft may be used as desired.

Generally, the apparatus disclosed herein is intended for high speed operation, and by eliminating the surrounding stationary casing, friction losses are reduced for the rotor. Such friction losses are high for fluids such as water, where water is at a high pressure. Friction losses within the rotor of this device are low, due to the normally low velocity differentials within the rotor between the fluid and the rotor.

Applications for this pressurizer include pumping of liquids, and as a gas compressor.

The function of the recirculation passages 15 were disclosed in a previous patent application "Rotor with Recirculation", Ser. No. 636,310, filed Nov. 28, 1975.

The free vortex cavity is shaped as a circular path, generally transverse to the rotor axis, and the working fluid injected into the cavity tangentially, with speed that is the sum of the local rotor speed at the entry nozzles, and the fluid tangential velocity leaving the nozzles. The fluid decelerates relative to the rotor as it travels outwardly, and normally the rotor tangential speed and the fluid tangential speed are the same at rotor periphery. The fluid pressure is usually nearly nil at the center of the free vortex cavity, and increases with increasing radius due to the centrifugal force of the rotating fluid. The free vortex cavity is usually tapered as shown to allow for the maintenance of the required high velocities within the cavity relative to rotor. Normally, the fluid entry pressure to the unit is elevated, and additional pressure is generated in the pressurizing cavity, so that the leaving velocity of the fluid relative to nozzles when entering the free vortex cavity is the result of the pressure drop entry plus centrifugal pressure in pressurizing cavity, to nil. By this means, the needed high fluid velocities in the free vortex cavity are obtained.

I claim:

1. A fluid pressurizer comprising:

a. a shaft mounted for rotation;

b. a rotor mounted on said shaft to rotate therewith, said rotor being provided with an entry for a fluid to be pressurized, said entry communicating with a pressurizing cavity extending outwardly from the rotor center, said pressurizing cavity communicating with a set of feeder nozzles for passing a fluid forwardly in the direction of rotation into a free vortex cavity of circular configuration and transverse to the rotor axis, said free vortex cavity communicating near its periphery with exit openings to allow the discharge of the fluid from the free vortex cavity.

2. The fluid pressurizer of claim 1 wherein said rotor is further provided with a set of inwardly extending passages for the fluid for passing the fluid into an exit near the rotor center.

* * * * *